United States Patent [19]

Sargent et al.

[11] 4,185,337

[45] Jan. 29, 1980

[54] PORTABLE TOILET WITH IMPROVED FLUSH APPARATUS

[75] Inventors: Frank T. Sargent; John M. Antos; Arthur W. Henke, all of Ann Arbor; James T. Embach, Saline, all of Mich.; Frederick A. Butler, Leamington Spa, England; Erin J. Lindsay, Ann Arbor, Mich.

[73] Assignee: Thetford Corporation, Ann Arbor, Mich.

[21] Appl. No.: 945,814

[22] Filed: Sep. 26, 1978

[51] Int. Cl.[2] ..... E03D 5/01; E03D 5/10; H01H 13/06

[52] U.S. Cl. ..... 4/300; 4/321; 4/406; 4/410; 200/302; 417/410

[58] Field of Search ..... 4/300, 317–323, 4/329, DIG. 3, 406, 410, 422, 437, 249; 200/302, 333, 83 C; 417/40, 472, 33, 473, 902, 410, 422

[56] References Cited

U.S. PATENT DOCUMENTS

| | | | |
|---|---|---|---|
| 2,741,987 | 4/1956 | Murphy et al. | 417/33 |
| 2,854,536 | 9/1958 | Beer | 200/302 X |
| 3,246,186 | 4/1966 | Schaefer | 417/40 X |
| 3,539,747 | 11/1970 | Robinson | 200/83 C X |
| 3,570,018 | 3/1971 | Sargent et al. | 4/321 |
| 3,583,675 | 6/1971 | Palmer | 4/317 X |
| 3,593,346 | 7/1971 | Katona | 4/317 X |
| 3,949,430 | 4/1976 | Miller et al. | 4/321 |
| 4,080,104 | 3/1978 | Brown, Jr. | 417/40 X |
| 4,080,105 | 3/1978 | Connell | 417/33 |

*Primary Examiner*—Stuart S. Levy
*Attorney, Agent, or Firm*—Olsen and Stephenson

[57] ABSTRACT

A portable sanitation unit is disclosed of the type having two vertically stacked sections, the lower section being a holding tank and the upper section including a toilet bowl, a water tank for storage of water for flush purposes, and an improved pump apparatus for flushing the toilet bowl, said apparatus comprising an electrically operated pump that can be energized from any suitable electrical source, such as a portable battery, an electrical receptacle in a motor vehicle, a cottage, a marine vessel, or the like.

6 Claims, 2 Drawing Figures

PORTABLE TOILET WITH IMPROVED FLUSH APPARATUS

BACKGROUND OF THE INVENTION

The present invention relates to portable toilets of the type disclosed in U.S. Pat. No. 3,570,018, patented Mar. 16, 1971 in the names of Sargent et al. and U.S. Pat. No. 3,949,430, patented Apr. 13, 1976 in the names of Miller et al., and is particularly directed to improvements in the pump apparatus of toilets of this character.

It is conventional practice when flushing portable toilets of this type to utilize manually actuatable pumps of the bellows type for pumping water from the water storage tank of the toilet into the toilet bowl. Arrangements that utilize this type of pump are disclosed in the above-cited patents. Pumps of the bellows type are low cost items which allow water conservation to be observed, and have proved to be satisfactory for the needs of the industry. However, the substantial growth in popularity of these toilets has created a demand in some instances for an improved pump apparatus that can be operated more easily than heretofore, while still providing the other virtues of a portable toilet of the foregoing character that are desired. For example, it has been found in some instances that handicapped or elderly persons may experience difficulty in operating a bellows pump so that there is a need for an improved pump apparatus that can be actuated more easily.

SUMMARY OF INVENTION

The present invention has overcome inadequacies of the prior art and has provided a portable toilet with an improved flush apparatus. In particular, the present invention provides, as an improved feature, pump apparatus which employs an electrically operated submersible pump and an electric switch conveniently located to facilitate ease of operation for starting and stopping operation of the pump. The switch is normally open so that the flushing operation will occur only when the switch is maintained closed by continuously exerting pressure on the switch. By virtue of this construction, only the minimum quantity of water required for an effective flush will be used. Also, handicapped or elderly persons can flush the toilet without being required to oscillate the bellows of the pump.

One of the features of the pump apparatus is the construction and arrangement of a housing in which the pump and switch are inserted during initial assembly and by which these components can be retained in operative positions in the conventional aperture in the water storage tank which was utilized in prior art constructions for mounting the bellows pump. This feature permits use of standardized water storage tanks in portable toilets which utilize either electrically operated pump apparatus embodied in the present invention or bellows operated pump apparatus embodied in prior art toilets of the types disclosed in the above-cited patents.

Another feature of the present invention is the construction and arrangement of the aforesaid housing by which the housing functions to hold the pump against the bottom of the water tank. Still another feature of this housing is its construction and arrangement whereby it allows the pump switch which is located within the housing to be actuated by exerting downward pressure on the housing from a location externally thereof. Still another feature of the housing is its construction and arrangement for holding the pump casing and providing a seal between the housing and the pump casing so that water cannot escape from the tank during instances when the toilet is being transported.

Other objects of this invention will appear in the following description and appended claims, reference being had to the accompanying drawings forming a part of this specification wherein like reference characters designate corresponding parts in the several views.

DESCRIPTION OF THE PRESENT EMBODIMENTS

Figure 1:
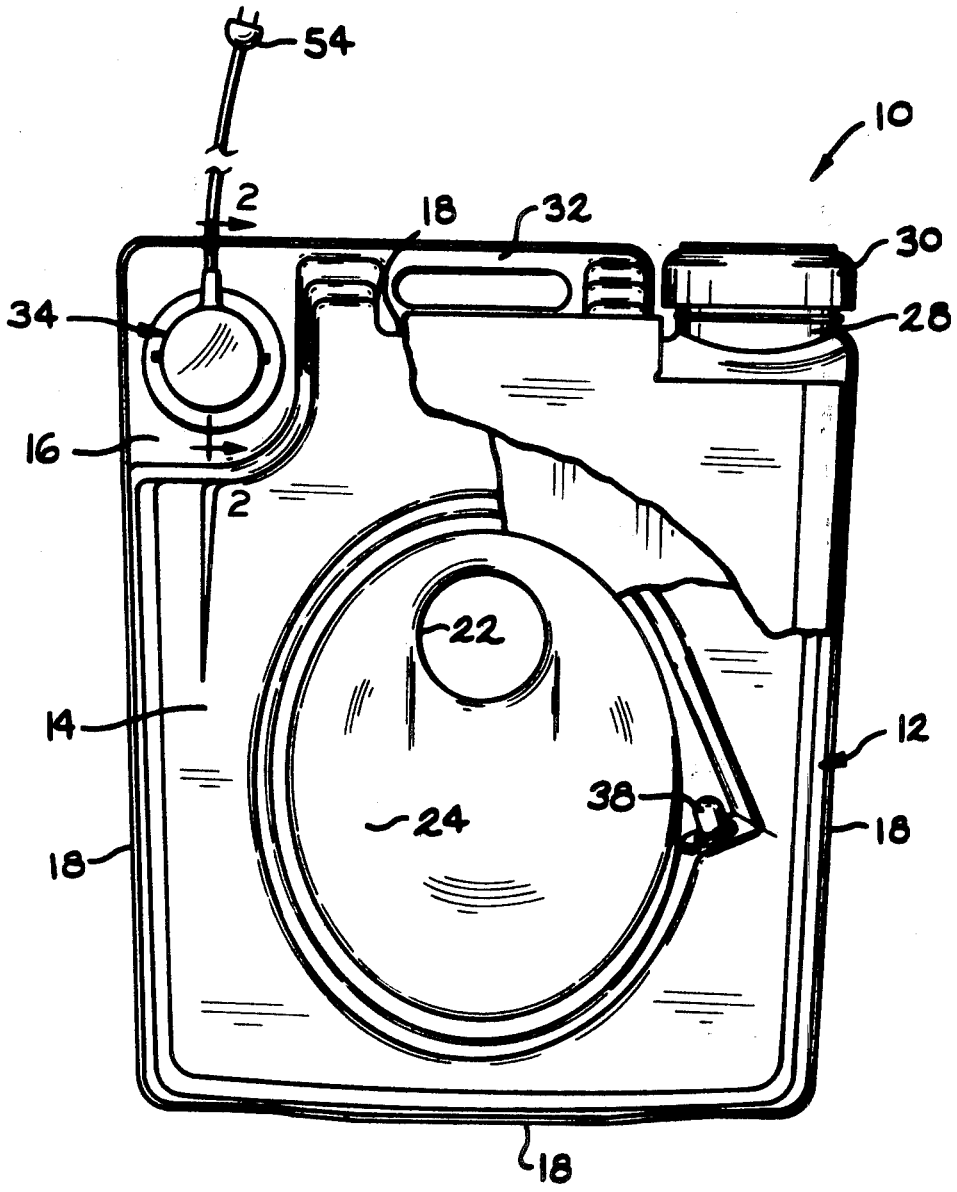
FIG. 1 is a top plan view, with portions removed for purposes of illustration, of a portable toilet embodying one form of the present invention.

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Referring now to the drawings the invention will be described in greater detail. The portable toilet 10 comprises a lower holding tank section (not shown) and the upper seat section 12 removably supported thereon. The upper seat section 12 is molded of a suitable thermoplastic material so as to have a top wall 14 and an associated top wall portion 16, side walls 18 and bottom wall 20 with an opening 22 in the bottom wall providing an outlet port. The upper seat section also defines a bowl 24 extending between the top and bottom walls 14 and 20, which opens at the bottom to said outlet port 22. A flush water compartment 26 is provided in the space surrounding the bowl 24 within the confines of the side walls 18 and the top wall 14, top wall portion 16 and the bottom wall 20. A spout 28 is provided in the rear side wall 18 for filling flush water into the flush water compartment 26, and a closure cap 30 is provided for closing the spout 28. A handle 32 is also molded in the rear side wall 18 for carrying the upper seat section 12.

The upper seat section 12 contains the pump apparatus 34 which includes the passageway 36, the discharge nozzle 38, the submersible pump 40, the electrical switch 41, and the housing 42.

The submersible pump 40 may be any conventional type of pump which has a water inlet at or adjacent to its bottom side 44 and discharge outlet at 46 which is in communication with the passageway 36 that in turn discharges to the nozzle 38 for flow of water in a vortex pattern into the bowl 24. The submersible pump 40 has a casing 48 which preferably is cylindrical in shape and which has a conduit 50 at its upper end through which the electrical conductor 52 extends for connection in the conventional manner to the switch 36 and electrical plug 54.

Figure 2:
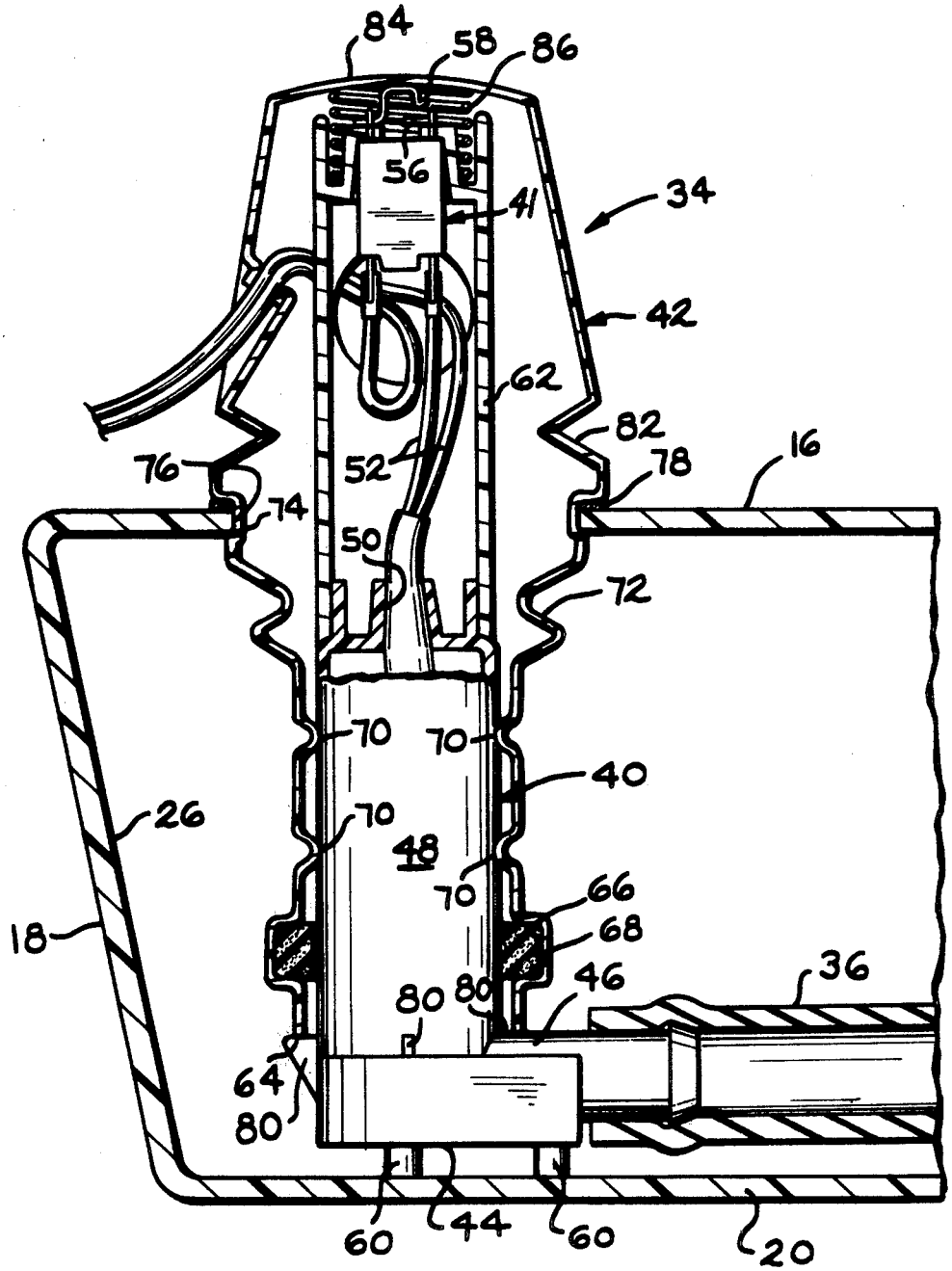
FIG. 2 is an enlarged fragmentary section taken on the lines 2—2 of FIG. 1, showing in vertical section the pump and its associated switch retained within a housing that is in the water tank of the portable toilet.

The switch 41 has contacts 56 and 58 which can be closed to energize the submersible pump 40 by depressing the contact 58, which has spring properties normally holding it in the open position shown in FIG. 2.

For the purpose of supplying direct current electric power, the electric plug 54 can be inserted into the outlet of a portable battery, motor vehicle, marine vessel, or the like, or by use of a conventional adaptor, to the outlet of any suitable alternating current supply.

The submersible pump 40 has four legs 60, only two of which are shown in FIG. 2, for supporting the submersible pump 40 on the bottom wall 20. During initial installation, the switch 41, which is supported on the top of the submersible pump 40 by a rigid sleeve 62, and the submersible pump 40 are retained in position by means of the housing 42 into which they were inserted axially through the open lower end 64. The housing 42 has annulus 66 adjacent to its lower end 64 in which a annular seal 68 is retained for providing a seal between the housing 42 and casing 48 so as to prevent escape of water from the compartment 26 between the housing 42 and casing 48. The housing 42 also has a plurality of interference bumps 70 which project inwardly to engage with the casing of the pump so as to retain the pump in a fixed position relative to the housing 42.

The housing 42 has a bellows section 72 between the lower end or edge 64 and the portion 74 which is attached to the edge of the aperture 76 in the top wall portion 16. The portion 74 is sealed to the edge 76 by a suitable sealing cement, as shown at 78. The lower edge 64 is seated on the abutments 80, and the bellows section 72 has elastic properties tending to urge the legs 60 of the submersible pump 40 against the bottom wall 20. By virtue of this construction and arrangement, the inlet of the pump that is located in the lower side 44 thereof will be maintained adjacent to the bottom wall 20, but in spaced relationship so as not to interfere with the flow of water into the pump.

The housing 42 also contains a bellows section 82 between the portion 76 of the housing and the top wall 84 thereof so that the top wall 84 can be manually depressed against the contact 58 of switch 41 to close the same, and upon releasing the pressure the bellows section 82 will cooperate with the coil spring 86 that is mounted between the sleeve 62 and the top wall 84 to urge the latter to its open position shown in FIG. 2.

From the foregoing description it will be understood that an improved pump apparatus has been provided which has controls therefor that are easily accessable to the user of the toilet for flushing the toilet. The controls allow water to flow only so long as the user holds the control switch in a closed position, thereby assuring that water conservation can be practiced.

It is claimed:

1. A portable toilet that includes a portable upper section providing a bowl that has an opening at the bottom and providing a water tank for storage of water for flushing said bowl, said water tank having an aperture in a top wall portion thereof for mounting a manually actuatable pump apparatus for pumping water from said tank to said bowl for flushing purposes, characterized in that a pump apparatus is mounted on said top wall portion comprising an electrically operated submersible pump having a water inlet located adjacent to the bottom of said tank and an electrical switch for energizing said pump when the switch is closed, said switch being located externally of said tank for manual actuation and rigidly mounted on said pump at an elevated position above said top wall portion, said switch being normally biased open and responsive to pressure exerted thereon to move to a closed position so that flushing of said bowl can occur only while said switch is maintained closed by the exerted pressure, and a housing encloses said switch and the upper portions of said pump in sealed relationship, seal means are provided between the lower end of said housing and said pump to prevent escape of water from the tank into said housing, said housing also being secured in a sealed relationship to the edge of said aperture in said top wall portion and being flexible to permit deflection of the housing for actuation of the switch therein.

2. The portable toilet that is defined in claim 1, and further characterized in that said flexible housing has interference bumps project inwardly into engagement with said pump to retain the pump in a fixed position relative to the housing.

3. The portable toilet that is defined in claim 1, and further characterized in that said housing has a bellows section between its top wall and its portion that is attached to the edge of said aperture so that said top wall of said housing can be manually depressed against said switch for closing the latter.

4. The portable toilet that is defined in claim 3, and further characterized in that spring means are mounted between the top wall of said housing and said switch for urging the top wall upward to a position wherein said switch will be in a normally open position.

5. A portable toilet that includes a portable upper section providing a bowl that has an opening at the bottom and providing a water tank for storage of water for flushing said bowl, said water tank having an aperture in a top wall portion thereof for mounting a manually actuatable pump apparatus for pumping water from said tank to said bowl for flushing purposes, characterized in that a pump apparatus is mounted on said top wall portion comprising an electrically operated submersible pump that has a water inlet located adjacent to the bottom of said tank and an electrical switch for energizing said pump when the switch is closed, said switch being rigidly mounted on said pump and located externally of said tank at an elevated position above said top wall portion for manual actuation, a housing encloses said switch and the upper portions of said pump, said housing being secured in a sealed relationship to the edge of said aperture in said top wall portion, said pump has a casing with abutment means adjacent to its lower end, and said housing has its lower edge seated on said abutment means, said housing having a bellows section between its lower edge and its portion that is attached to the edge of said aperture, said bellows section having resilient properties for urging said lower edge against said abutment means so that the pump is held against the bottom wall of said tank.

6. The portable toilet that is defined in claim 5, and further characterized in that said pump has its inlet on the bottom side of said casing, and said casing has legs projecting downwardly on which the pump is supported on said bottom wall of the tank to space said inlet from said bottom wall.

* * * * *